US009739498B2

(12) United States Patent
Katz

(10) Patent No.: US 9,739,498 B2
(45) Date of Patent: Aug. 22, 2017

(54) MULTI-MODE PASSIVE INFRARED OCCUPANCY SENSOR SYSTEM FOR ENERGY SAVING APPLICATION

(71) Applicant: Fred Katz, Hauppauge, NY (US)

(72) Inventor: Fred Katz, Hauppauge, NY (US)

( * ) Notice: Subject to any disclaimer, the term of this patent is extended or adjusted under 35 U.S.C. 154(b) by 72 days.

(21) Appl. No.: 14/668,947

(22) Filed: Mar. 25, 2015

(65) Prior Publication Data

US 2016/0003493 A1 Jan. 7, 2016

Related U.S. Application Data

(60) Provisional application No. 62/020,666, filed on Jul. 3, 2014.

(51) Int. Cl.
*F24F 11/00* (2006.01)

(52) U.S. Cl.
CPC ... *F24F 11/0034* (2013.01); *F24F 2011/0035* (2013.01)

(58) Field of Classification Search
CPC ..... G05B 15/02
USPC ..... 700/85
See application file for complete search history.

(56) References Cited

U.S. PATENT DOCUMENTS 5,219,226 A * 6/1993 James ..... G01J 5/02 345/167
5,455,487 A * 10/1995 Mix ..... H05B 37/02 315/150
5,668,446 A * 9/1997 Baker ..... H05B 37/02 315/158
6,791,458 B2 * 9/2004 Baldwin ..... G01S 13/04 340/521
6,909,921 B1 * 6/2005 Bilger ..... G05B 15/02 700/14
7,474,477 B2 * 1/2009 Claytor ..... G02B 3/08 359/356
9,066,028 B1 * 6/2015 Koshti ..... H04N 5/33
(Continued)

OTHER PUBLICATIONS

CN201120433811, Liu, p. 1-2, published Aug. 15, 2011.*

*Primary Examiner* — Christopher E Everett
(74) *Attorney, Agent, or Firm* — John F. Vodopia

(57) ABSTRACT

A passive infrared (PIR) motion sensor system includes a non-contact thermopile detector for capturing infrared energy from a focused upon area in a room or zone deemed most likely to be occupied and generating a thermopile temperature signal therefrom, a pyroelectric detector for viewing through multiple passive lens elements (lenslets) that form PIR beams from a large portion of the room or zone and generating a pyroelectric signal therefrom, an ambient temperature sensor for sensing an ambient temperature in the room or zone and generating an ambient temperature signal detection threshold that is utilized in PIR detection therefrom and a microcomputer configured to process the thermopile temperature signal, the pyroelectric signal and the ambient temperature signal and determine whether the room or zone is occupied or unoccupied. An electrical current supply or occupied signal is transmitted to the room or zone is maintained when the microcomputer determines that the room or zone is still occupied and is interrupted when the microcomputer determines that the room or zone is unoccupied.

11 Claims, 9 Drawing Sheets

(56) References Cited

U.S. PATENT DOCUMENTS

| | | | | |
|---|---|---|---|---|
| 2005/0264414 | A1* | 12/2005 | Sweeney | F24F 11/0034 340/522 |
| 2010/0052576 | A1* | 3/2010 | Steiner | H05B 37/0227 315/361 |
| 2010/0188218 | A1* | 7/2010 | Roosli | G08B 21/22 340/545.1 |
| 2010/0289643 | A1* | 11/2010 | Trundle | F24F 11/0086 340/545.1 |
| 2011/0267186 | A1* | 11/2011 | Rao | B60K 28/08 340/449 |
| 2012/0068611 | A1* | 3/2012 | Steiner | H05B 37/0272 315/155 |
| 2012/0068686 | A1* | 3/2012 | Steiner | H05B 37/0272 323/318 |
| 2014/0277765 | A1* | 9/2014 | Karimi | G05B 15/02 700/276 |
| 2016/0234916 | A1* | 8/2016 | Mans | H05B 37/0227 |

* cited by examiner

Fig. 6

EXAMPLE OF A WEIGHTED TIME AVERAGED FACTOR

A3 - EARLIEST MEASUREMENT

A2 – NEXT TO EARLIEST MEASUREMENT

A1 – NEXT TO LAST MEASUREMENT

A0 – LAST MEASUREMENT

WEIGHTED TIME AVERAGE = 1/8 x A3 + 1/8 x A2 + 1/4 x A1 + 1/2 x AO

A SIMILAR METHOD IS USED TO CALCULATE CALIBRATION AND THRESHOLD VALUES

Flow Diagram

MULTI-MODE PASSIVE INFRARED OCCUPANCY SENSOR SYSTEM FOR ENERGY SAVING APPLICATION

CROSS-REFERENCE TO A RELATED APPLICATIONS

The invention described and claimed hereinbelow claims priority under 35 USC §120 from U.S. Provisional Patent Application Ser. No. 62/020,666, filed on Jul. 3, 2014, the contents of which are incorporated by reference herein.

BACKGROUND OF THE INVENTION

Many known room occupancy sensors use Passive Infrared (PIR) motion sensors (sometimes commonly referred to as occupancy sensors) located on the ceiling and/or wall and/or near a doorway in a room to determine whether a person is present in the room and control the lighting and/or environmental conditions in the room accordingly. For example, known occupancy sensors sense a person entering a previously unoccupied room when the entering person traverses one or more PIR beams from a PIR motion detector positioned to monitor a doorway and based on the sensing, actuates or enables the room's lighting in the occupied state to illuminate the room. Subsequent motion in the room by the occupying person provides for maintaining the occupied state (and the illuminated lighting) by re-triggering the PIR motion detector positioned at the entrance and/or positioned on the ceiling and/or wall.

When a person is seated at a desk, however, the person's motion may be so slight (micro-motion) that it is insufficient to properly trigger a PIR motion detector (the backbone of conventional room occupancy sensors) to maintain the occupied state and the supply of current to the room or monitored zone. PIR motion detectors only respond when the target crosses at least one passive beam, formed by a multi-faceted lens that is operates to direct the beam to a PIR motion detector as part of the conventional occupancy sensor and a person's smaller motions at times do not cross the beam zone boundaries so detection is not determined. So where further "presence" detection is required to maintain an occupied status, the occupancy sensor may change the status to "unoccupied" by failure to detect small micro-motions and consequently inadvertently interrupt the source of electrical power. If the room was illuminated prior to the change of status from occupied to unoccupied, the lights become extinguished as the conventional sensor stops the supply of electrical current with said change of state.

At that point, the person seated at the desk experiences the lights being switched from an "on" state to an "off" state and must wave their arms or stand up and walk to cross a beam in order to re-trigger the motion sensor to change back to an occupied state and thereby again actuate the room's lighting.

SUMMARY OF THE INVENTION

The present invention overcomes the shortcomings of known motion sensors and known occupancy sensors based on PIR motion detectors.

The invention provides a multi-mode passive infrared (PIR) motion sensor and non-contact temperature sensor system that operates to detect a presence of a person typing, reading or even sleeping in a chair, couch or bed or just standing without the need for continuous motion. As such, the inventive PIR occupancy sensor system accurately maintains the room's status as 'occupied' or 'unoccupied'. When detecting that a room or monitored zone is occupied even where the occupant is substantially dormant, the inventive PIR occupancy sensor system controls the pathway for electrical power delivered to the room or zone, maintaining the lights, heat and/or air conditioning, or other service, in an "on" state rather than being automatically switched off by a wrongful determination that the room is no longer occupied.

The inventive PIR occupancy sensor system may be used as an adjunct to a conventional occupancy sensor as an enhanced or supplemental technique to detect the presence of a person who may not be as active as someone walking within an area or zone or room's floor plan. Inventive operation is based on a premise that non-powered (and inanimate) objects present in a room eventually stabilize at the room's ambient temperature, which is substantially equivalent to the temperature of the air in the room. This state is called thermodynamic equilibrium, where the inventive PIR occupancy sensor system and method of use relies upon the principle of thermodynamic equilibrium of background and the thermal temperature of a room occupant being significantly different the majority of the time. The contrast in infrared temperature of the occupant and the background surfaces is what is utilized by this invention, without the need for a subject's motion.

For example, the inventive PIR occupancy sensor system may be mounted on a ceiling, wall or door, table or other stationary structure found in a room or monitored zone positioned so that a non-contact thermopile detector that is part of the PIR occupancy sensor system "points to" or sees a first object in a target area, such as the center of a desk, a desk chair, a couch, a bed, a table, a nightstand, a bathroom toilet, a position on a floor, etc. This first object may be said to be the object under observation. "Points to" or "sees" as used herein is meant to convey a direction at which the inventive non-contact temperature sensor's direction is focused, for example, such that a field of view (FOV) of the non-contact thermopile detector captures is an area in which the sedentary object under observation is contained. The inventive PIR motion sensor system portion has a wider FOV and monitors both the previous narrow area and larger surrounding premises and the non-contact thermopile detector monitors the narrower FOV and its contents, which may or may not include a stationary occupying person.

The inventive PIR occupancy sensor system implements a non-contact 'thermometer' technique to measure a temperature of the first solid object that it "sees" in the focused FOV, i.e., in the area or monitored zone. If the area or monitored zone is not occupied by a person, the inventive non-contact thermopile temperature sensor system portion "sees" only the solid and inanimate objects and senses the temperature thereof. If the area or monitored zone is occupied by a person, the inventive PIR occupancy sensor system "sees" the occupying person's skin or clothing, and senses the temperature thereof and calculates the temperature difference from the background temperature which determines a person's presence.

The inventive PIR occupancy sensor system not only measures a surface temperature of the first object that it "sees" (whether a person or background, i.e., first inanimate object), but also includes means for measuring the ambient air temperature of the room or monitored zone. If no person is present in the room or monitored zone (unoccupied), the non-contact temperature measurement of the first object or background should be extremely close to or exactly the ambient air temperature of that area. If a person is present in the room's monitored zone (occupied), the inventive PIR occupancy sensor system measures a temperature of the clothing or skin of the occupant, which should be higher than the conventional ambient temperature.

The inventive PIR occupancy sensor system calculates the temperature difference between the non-contact measurement of the first object and the ambient air temperature in the room or monitored zone. If the temperature difference is significant, for example, greater than or equal to 5 Fahrenheit degrees, the inventive PIR occupancy sensor system decides that the room or monitored zone is occupied and prevents a cutoff of the supply of electricity to the room or monitored zone. If the temperature difference is insignificant, for example, less than or equal to 5 Fahrenheit degrees, the inventive PIR occupancy sensor system decides that the room or monitored zone is unoccupied, where cuts off the supply of electricity to the room or monitored zone.

When the PIR, motion sensing detection portion of the occupancy sensor system is in the unoccupied state and detects a person's presence, the system changes state to the occupied state from the unoccupied state. Upon changing into the unoccupied state, a message can be transmitted indicative of said state change and power can be interrupted to the light, heating ventilation and air conditioning or other service. If both the PIR motion sensing portion and the temperature measurement thermopile detector determine that there is no motion and no heated body present, the status changes to unoccupied. Upon changing occupied to unoccupied, the inventive PIR occupancy sensor system sends a message to the energy controller to interrupt or diminish the supply of electricity. Upon detecting a person's presence while in the unoccupied state, or a person's continued presence in an occupied state, the inventive PIR occupancy sensor system switches to or maintains the occupied state ensuring full electrical supply to the room or monitored zone's required lighting and/or temperature control.

As such the inventive PIR occupancy sensor system and method of using same accurately detects a presence of a person in the monitored room or monitored zone regardless of whether the person is stationary for long periods of time because the invention relies upon temperature of the surface of a person or their clothing, in comparison with the room temperature, in addition to sensing whether the person has moved within the wider area of the room or zone.

DESCRIPTION OF THE DRAWINGS

Further features and advantages of the invention will become apparent from the description of embodiments that follows, with reference to the attached figures, wherein:

FIG. 6 depicts one example of a weighted time average that could be used as the calibration factor.

DETAILED DESCRIPTION OF THE INVENTION

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Inventive operation of the inventive PIR occupancy sensor system is supported by non-contact temperature measurement means that is focused upon an area, room or monitored zone where a person is likely to be sitting or standing and a processing function or controller that compares the temperature measured at the focused upon area to a measured ambient air temperature in the monitored zone and evaluates a difference in the temperatures (if any) to determine a likelihood that the focused upon area is occupied by a person. The evaluation or determination is based on a presumption that the focused upon area will have a temperature that is affected by the presence of the person that differs from the non-occupied background temperature.

The inventive PIR occupancy sensor system will be arranged to work in conjunction with a conventional motion-based occupancy sensor (which relies on a detected motion alone), as a two-part system, providing the advantage that even where no motion is detected by the conventional occupancy sensor, full electrical power to the illumination or temperature controller within the room or monitored zone which is maintained regardless of relatively stationary behavior of an occupying person as long as the inventive PIR motion sensor system senses that the stationary warm body is nevertheless present in the monitored zone or room based on the temperature difference calculated.

The inventive PIR motion sensor system can be mounted on the ceiling, at a doorway, on a wall, on or upon an apparatus or furniture (preferably stationary) as long as the mounting position allows the detectors therein to be pointed or focused on a 'possibly' occupied area, i.e., the monitored zone, room or area most likely occupied by a stationary person.

Figure 1:
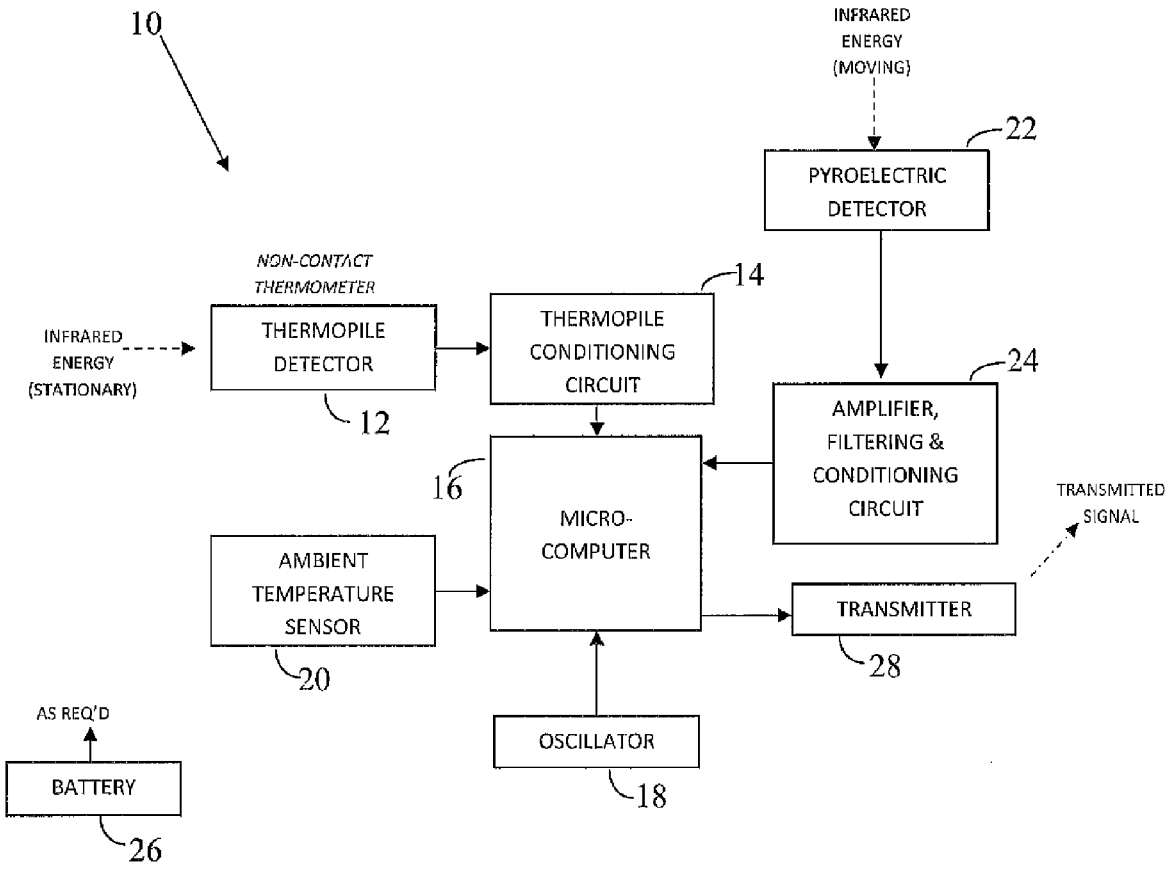
FIG. 1 FIG. 1 depicts a circuit schematic diagram of a first embodiment of a PIR motion sensor system of the invention.

FIG. 1 depicts a circuit schematic diagram of a first embodiment of a pyroelectric detector based PIR motion sensor and non-contact thermopile detector surface temperature measurement system 10 of the invention. As shown therein, system 10 includes a non-contact temperature measuring thermopile detector 12, which is a device for measuring surface temperature, by capturing infrared energy from a focused upon area (for example, a seat or chair), where a person might be located and who might remain substantially stationary for a length of time that might normally cause a conventional room occupancy sensor system to erroneously determine that the location is unoccupied. The thermopile detector 12 generates an electrical signal that is provided to a thermopile conditioning circuit 14, which pre-amplifies the thermopile detector signal.

The thermopile detector 12, or other device non-contact temperature measurement device, performs measurement of the surface of the occupant's skin or clothes, based on the infrared energy emitted from this surface or of the background if the person is not there. All objects emit infrared energy that can be measured with the proper apparatus. This temperature is called the 'black body temperature'. The thermopile detector, or other suitable non-contact temperature sensing component, is used to measure the surface temperature of either a person occupying the target area or the background of the target area, i.e., a first inanimate object therein. The ambient or air temperature sensor 20, can be a thermistor (temperature sensor resistor that changes resistance depending on its ambient temperature) for example. An alternate target instead of the seat or the chair is the floor in front of the occupant or the desk. The reason for that is that they are less likely to be heated up than the seat or the chair, when same is occupied by a warm body.

The pre-amplified thermopile detector signal is provided to a microcomputer 16. The microcomputer 16 is preferably a single integrated circuit that requires an oscillator 18. The oscillator 18 can be an external crystal, resonator or other type of oscillator or frequency resonant device, as shown, or there can be a built-in oscillator, included on the substrate that comprises the microcomputer. The microcomputer may comprise any processor or controller known to the skilled artisan and for example, and could be implemented using an Application Specific Integrated Circuit (ASIC) depending on the cost tradeoffs of the implementation. The external ambient temperature sensor 20 is implemented, for example, with a thermistor, that detects the temperature of the ambient air proximate the system 10 and generates an ambient temperature data that is utilized by the microcomputer. Preferably, the microcomputer 16 includes the ambient temperature sensor 20 built-in on or into the substrate that the microcomputer embodies. This microcomputer feature would obviate the necessity of a separate ambient temperature sensor or thermistor. Some microcomputers possess a substrate mounted diode for measurement of ambient temperature. This diode is extremely linear for temperature versus diode voltage, but may have an initial offset voltage that varies from part to part. This voltage offset error can be easily calibrated out after initial programming and a correction factor saved that makes this measurement extremely accurate subsequent to this calibration.

The PIR motion sensor portion of system 10 also includes a pyroelectric detector 22 for detecting motion of persons passing in front of one of many passive infrared (PIR) beams captured thereby, as known to the skilled artisan. A pyroelectric signal representative of the captured PIR beams is provided to an amplifier, filtering and conditioning circuit 24, where a conditioned PIR signal is provided to the microcomputer 16. A battery 26 supplies power to the components of the system 10, where required. Please note, that the system 10 may also be powered by the conventional AC line or mains power with appropriate power conditioning circuitry. The microcomputer 16 provides inter alia a signal representative of a determined occupied or unoccupied state to a transmitter 28, which then transmits a signal that communicates the determined state. The transmitter 28 may be any of an optical, wireless (electrical or electronic), acoustic, etc., without limitation. In alternate variations of this invention, provisions can be added that would actually do the power switching, still utilizing the technology of this invention.

Figure 2:
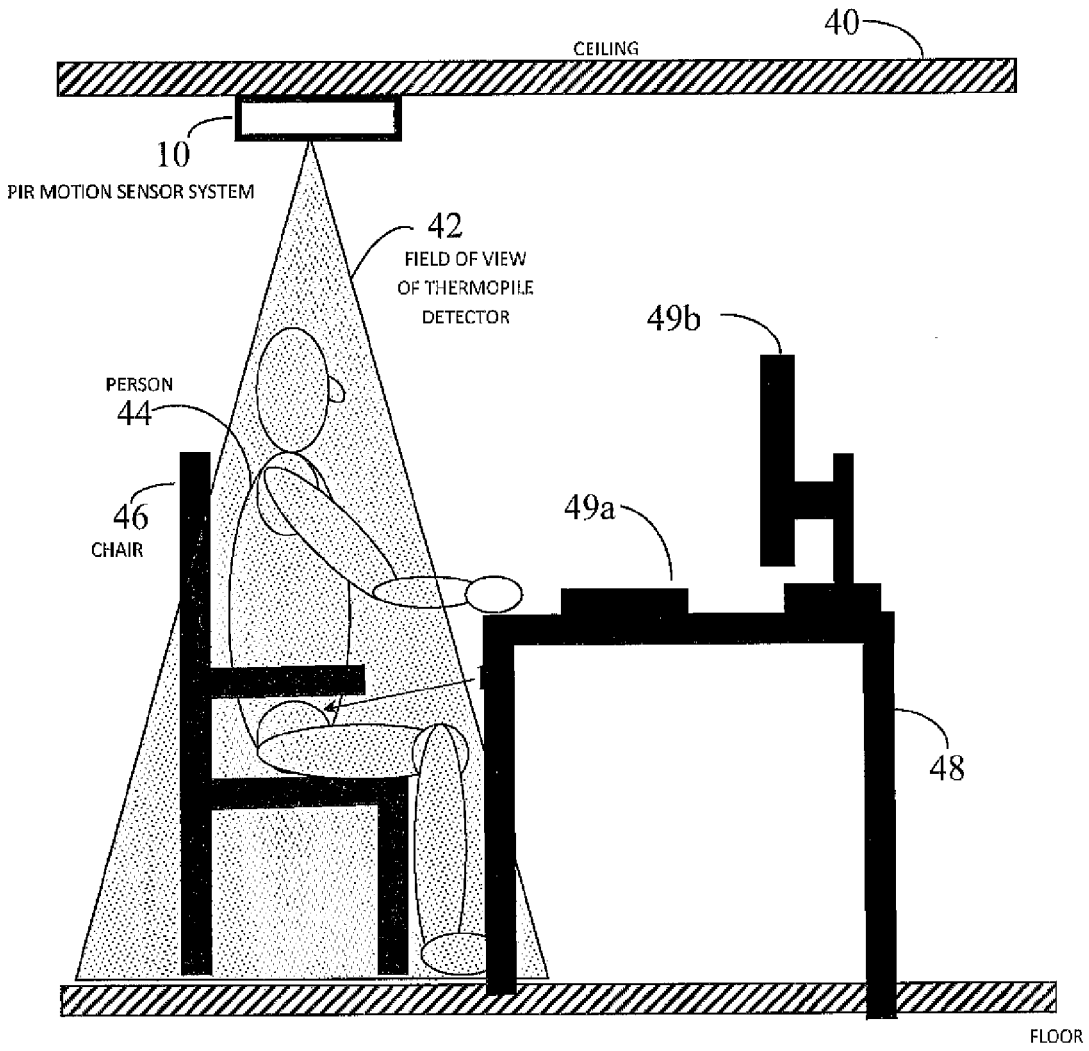
FIG. 2 shows the PIR motion sensor system mounted on a ceiling in an area or zone under protection

During intended use, the system 10 is positioned so that the thermopile detector 12 is aimed at or focused upon a center of a monitored area or zone most likely occupied by a person in a stationary state that is to be monitored. FIG. 2 presents one such exemplary arrangement. That is, FIG. 2 shows a PIR motion sensor system 10 mounted on a ceiling 40 in a room or zone under protection. The system is positioned so that the focused upon zone is captured in the field of view (FOV) 42 of the system broadly and the thermopile detector 12 in particular. As such, the thermopile detector 12 measures the temperature of the first solid object in the field of view (FOV) 42, i.e., the first closest object in the area or monitored zone in the thermopiles single beam path. The ambient temperature sensor 20 (such as a thermistor) measures the ambient temperature of the room or monitored zone. In FIG. 2, a person 44 is present in a chair 46 before a desk or table 48 operating a keyboard 49*a* that enables input to a computer 49*b*.

Presumptively, if no person were present in the focused upon area (i.e., FOV or monitored zone 42), the temperature of an inanimate object in the focused upon area, such as the chair 46 or desk 48, represented by the temperature signal detected by the thermopile detector 12, will be substantially equivalent to the ambient temperature detected by the ambient temperature sensor 20 and an unoccupied state is determined. But where there is a discernable temperature difference between the ambient temperature in the monitored zone or room and that the temperature determined by the thermopile detector, an occupied state is determined. There may be small temperature variations due to air conditioning or heating, but these effects are typically small and unlikely to affect an accuracy of an occupancy determination, because a normal temperature condition for an unoccupied seat, carpet, bed or non-powered object is always substantially equivalent to the ambient temperature when the room or zone is in thermal equilibrium. The fixed temperature difference value that triggers a finding of occupancy will have to be determined during empirical test of the invention. Slight alterations in the trigger value of this temperature difference can be also factored in based upon observations of changes in room air temperature due to forced heating or cooling, if found necessary.

FIGS. 3A, 3B, 3C and 3D, together depict an embodiment of the inventive PIR motion sensor system in which the above-described components of the system 10 are arranged on a printed circuit board 50, which is housed in a plastic case 60. The FIG. 3A view shows the arrangement on the surface of the printed circuit board 50, including clips 30 to electrically connect the printed circuit board to the battery 26, an antenna 32 connected to a filter & matching network 34, that receives the signal for transmission by transmitter 28. A circuit element 38 is representative of miscellaneous circuit components. These miscellaneous components comprise a collection of components, both active and passive that comprises a typical signal conditioning circuit typically used with a pyroelectric detector interface to a microcomputer. In addition, this includes a typical 'front end' of a passive infrared motion detector's interface to a microprocessor which also includes a collection of operational amplifiers, resistors and capacitors or custom Applications Specific Integrated Circuit (ASIC). The Power Controller is one or more Low Dropout Voltage Regulators.

Figure 3A:
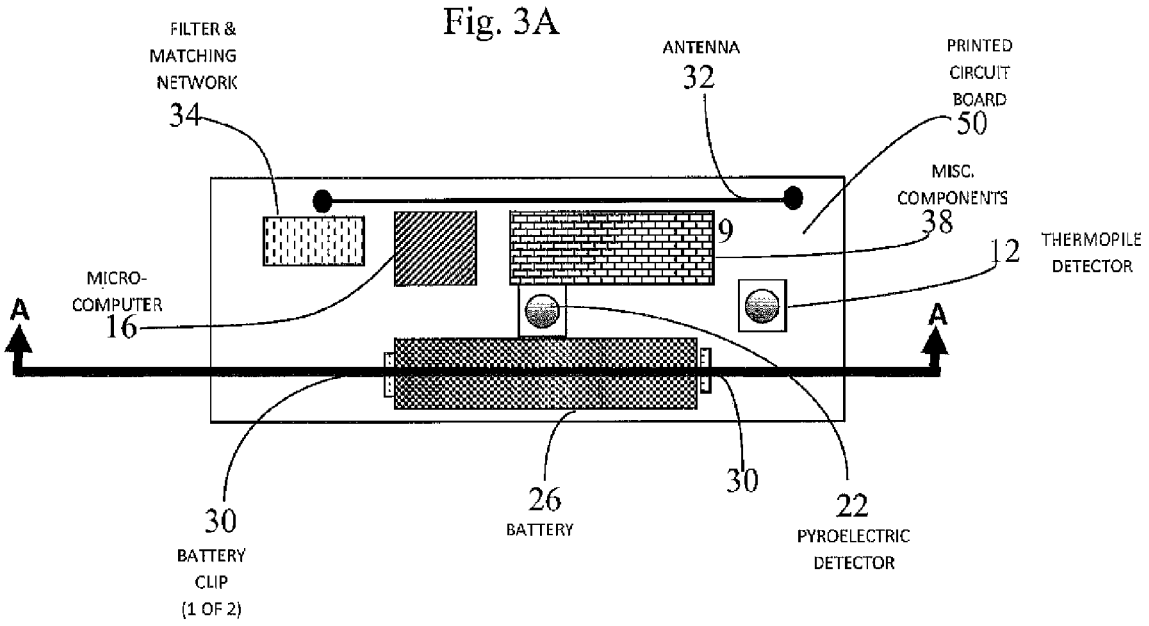
FIG. 3A depicts an embodiment of the inventive PIR motion sensor system arranged on a printed circuit board.
Figure 3B:
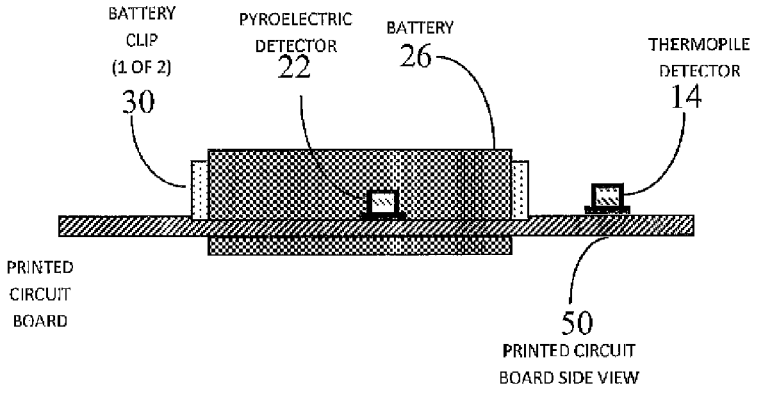
FIG. 3B shows a side view of the printed circuit board along the lines A-A in FIG. 3A.
Figure 3C:
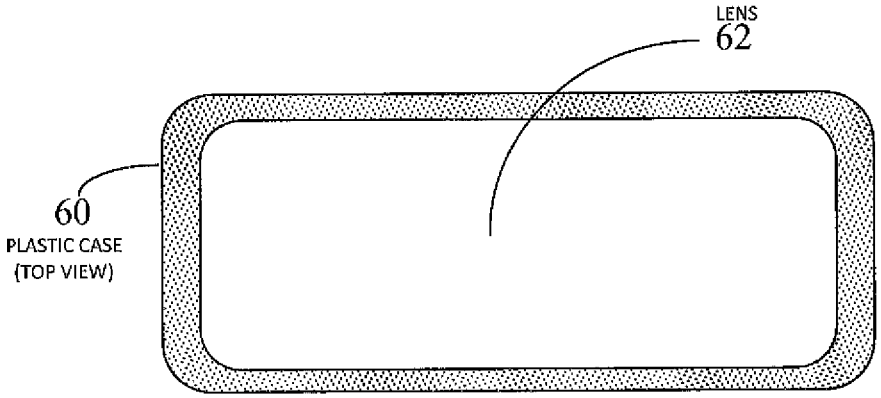
FIG. 3C depicts a plan view from above of a case within which the printed circuit board of FIG. 3A housed.
Figure 3D:
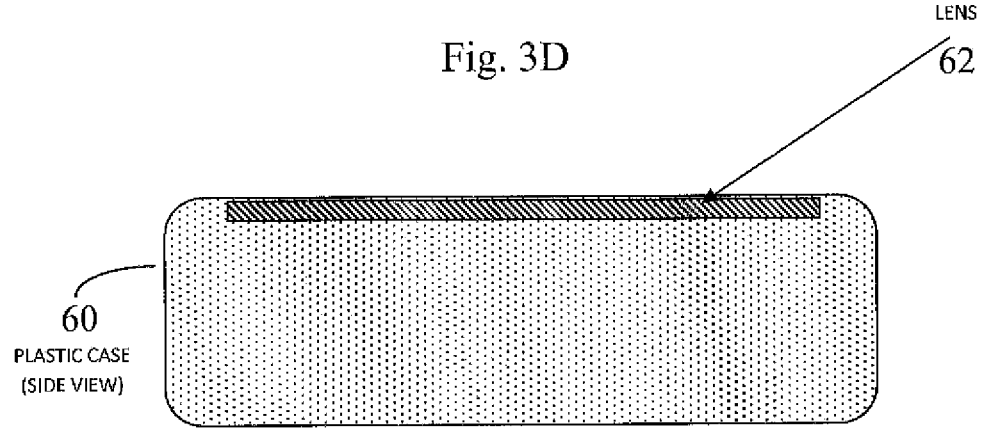
FIG. 3D depicts a side view of the case depicted in FIG. 30.

FIG. 3B shows a side view of the printed circuit board along the lines A-A in FIG. 3A. FIGS. 3C and 3D depict respectively a plan view from above and a side view representative of a case 60, preferably plastic, within which the printed circuit board 50 is housed. As shown therein, the case 60 is covered by a lens 62, which is transparent or semi-transparent to infrared energy/beams. It is to be noted that in this implementation a shared lens is shown, two separate lenses can be another implementation. The temperature measurement lens consists of a single lens or possibly just an infrared material without any lens, since the lens in the thermometric detector can be utilized. The portion of the lens for the Passive Infrared sensing will consist of multiple lenslets arranged in a coaxial or linear orientation suitable for the generation of multiple (passive) beams. A passive beam is defined as the defined optical path that a cone of infrared light energy would traverse as it goes between the subject walking person, the lenslet and the path as it is focused onto the surface of the pyroelectric detector. The detectors and ancillary electronics are packaged in a small enclosure, i.e., the plastic case 60 that is configured for mounting for the particular application. While the PIR motion sensor and thermopile non-contact measurement system 10 encased therein is battery powered, same may alternatively be powered by the common alternating current (AC) supply via a conventional AC-DC converter that converts the input voltage to approximately 3-12 VDC. In the illustration a lens that consists of two separate lens arrays, one for the pyroelectric and one for the thermopile detector. There is a single plastic Fresnel lens window shown, but this can also be implemented with two separate lenses dependent upon packaging and optical constraints. These two lenses partially control the field of view and optics of both sensors and serve to protect the volume within this invention from drafts and insects. The individual sensors' optics also contributes to the field of view.

For that matter, the PIR motion sensor system's microcomputer 16 while always powered is in "sleep" state most of the time, within which the system consumes almost no electrical power when in the unoccupied state. When the motion sensor portion of the circuitry senses a possible detection, the microcomputer 'wakes up' and verifies that it is the motion of a person. The system is programmed to wake up at periodic intervals, at which times the detector signals including from the FOV in the focused upon target area or monitored zone are rapidly measured to determine the target area or room's occupancy status. In addition, the system will wake up periodically to perform housekeeping functions such as calibration and messaging status to the external monitoring system that typically receives status change messages. Once determined, the system quickly shuts down (i.e., goes back into "sleep" mode), drawing minimal electrical energy from the battery until the next "wake up" period, ensuring long battery life. In the occupied state, the invention will periodically wake up and check the temperature in the monitor zone to see if the target individual has left the room. When the person leaves the room, there will be a detection noted by the motion sensor and the status will stay as 'occupied' for a short time, until the temperature of the monitored zone indicates the unoccupied position. This feature prevents the lights from turning off when the person is leaving the room.

In greater detail, the pyroelectric PIR detector 22, which is a low powered circuit, wakes up the microcomputer 16 when it detects a possible entry into the general area, i.e., the room or monitored zone, which included the area focused upon by the thermopile detector. Once a valid human target is detected, the lighting, HVAC or other energy producing item is energized, as required or a message is transmitted to effect energizing of the required item(s). At this point, the microcomputer processes the thermopile detector signal to determine if the target area temperature has changed. If it has not changed, this may indicate a transient human occupancy of the zone, meaning a person crossed the beam of the pyroelectric detector 22 but is not present in the FOV 42. But if the temperature in FOV 42 is determined to have increased, the FOV is determined to be occupied, i.e., occupying the target zone. At this point in time, temperature monitoring mode is initiated.

As already explained, using a conventional occupancy sensor, if no motion is detected by the sensor's PR detector in about 15 minutes, for example, the electrical supply to the room or monitored zone is interrupted by shutting down or reducing lighting/HVAC (Heating, Ventilation, Air Conditioning). The inventive PIR motion sensor system 10 provides for determining whether a person nevertheless is still in target area, i.e., at the focused upon area, using the thermopile detector 12, where a higher than ambient temperature therein evidence a person's presence therein. That is, if a stationary person remains, the electrical power supply is not interrupted and the lighting/HVAC remains on. During normal operation, when the area or monitored zone is determined to be unoccupied, the only part of the inventive PIR motion sensor system 10 that is operational is the pyroelectric PIR motion detector 22, as already explained.

When the inventive PIR motion sensor system 10 detects a change of occupancy status after the motion sensor detects a valid signal indicative of a person crossing a beam, the system transmits a signal indicative of the occupancy status. As explained with reference to FIGS. 1 and 3*b*, the communication signal may be transmitted optically; using a visible or invisible infrared beam, using ultrasonic tones beyond the range of human hearing or through a wireless electrical or electronic transmission or the unit may contain an energy control switching device.

Figure 4A:
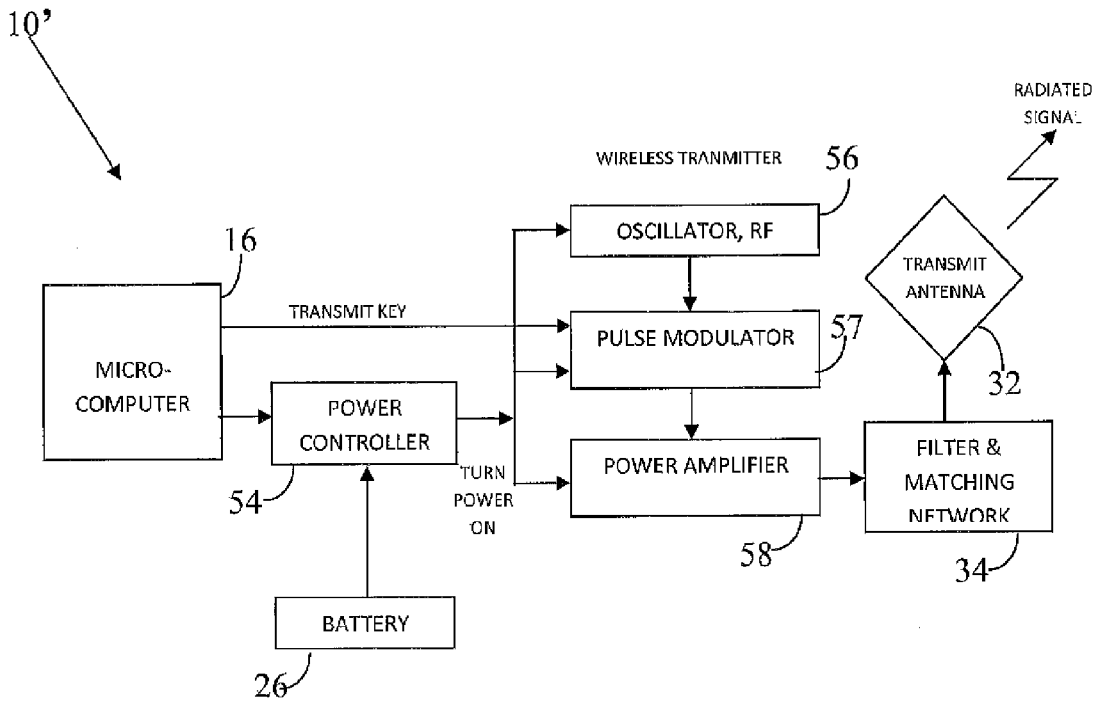
FIG. 4A depicts an alternative annunciation embodiment of a PIR motion sensor system 10' of the invention.

FIG. 4A depicts an embodiment of a PIR motion/thermopile sensor system 10' of the invention, to highlight wireless transmission operation. The FIG. 4A embodiment may be preferred with respect to those of FIG. 4B and FIG. 4C, which are less widely utilized as a communication technique. The wireless transmitter portion of the system includes an RF oscillator 56 that operates on the transmission frequency. A time base for the oscillator can be a quartz crystal, a resonator or other type of frequency stable device (not shown). The oscillator is connected to a pulse modulator 57, which provides an oscillator signal from RF oscillator 56 to a power amplifier 58 when a transmit key (signal) is received from the microcomputer 16. The transmit key is a signal that causes the emission of a burst of radio frequency from the wireless transmitter portion's power amplifier 58 into the transmit antenna 32. The output of the power amplifier 58 is coupled to the transmit antenna 32 by a passive component network 34 that matches impedance and filters out-of-band energy consisting of spurious frequencies. The transmit antenna 32 is either a short piece of solid wire or the trace on the printed circuit board 50. When not transmitting, the microcomputer 16 shuts off power to the entire wireless transmitter portion via power controller 54.

Figure 4B:
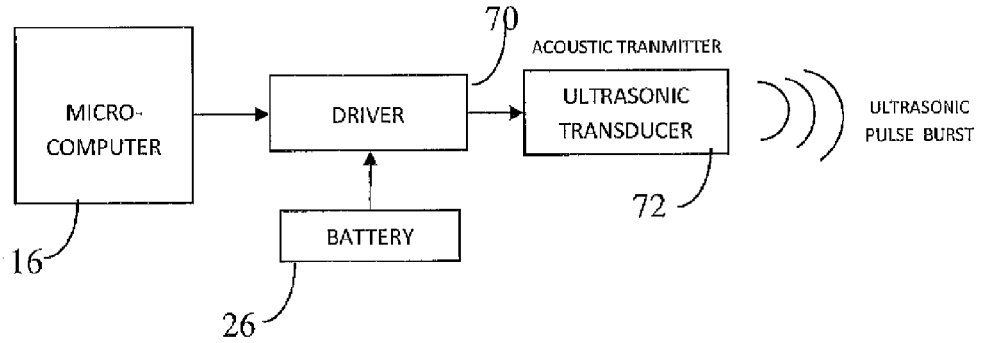
FIG. 4B depicts a schematic block diagram of an alternative annunciation embodiment of the FIR motion sensor that uses an acoustic transmitter to transmit data.

FIG. 4B shows an approach wherein the wireless transmitter portion operates acoustically, that is, the microcomputer 16 controls a current driver 70 to send a coded, gated burst of ultrasonic energy. This is beyond the range of human hearing so it appear silent to humans. Each pulse sent out is actually generated by a short burst of square waves whose frequency is that of the resonant frequency of the ultrasonic transducer 72. The current driver 70 is used to switch power from the battery 26 to (power) the ultrasonic transducer 72.

Figure 4C:
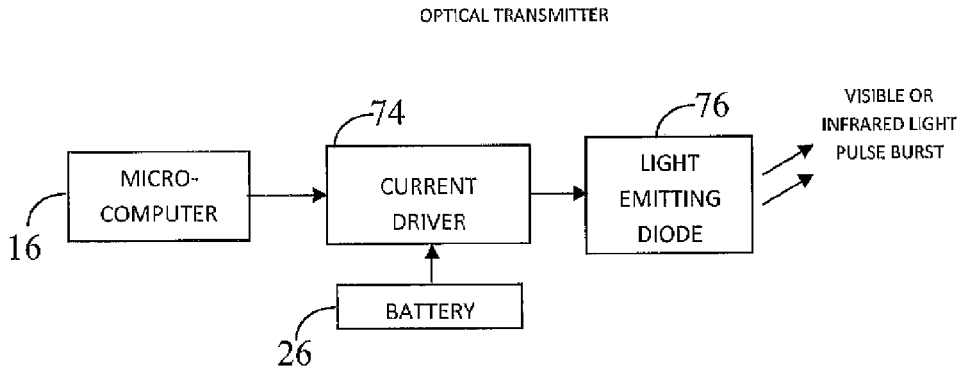
FIG. 4C depicts a schematic block diagram of an alternative annunciation embodiment of the PIR motion sensor that uses an optical transmitter to transmit data.

FIG. 4C shows an approach wherein the wireless transmitter portion operates a Light Emitting Diode (LED) 76 that is pulsed through control of the microcomputer 16. If required, a current driver 74 supplies sufficient current to flash the LED 76 with the pulse train 78 (FIG. 4D) comprising the necessary data to send out the information. The LED 76 can be within the visible or invisible infrared section of the color spectrum. When infrared is used it is invisible to the room occupants. The signal will be received by a receiving device that uses AC coupling and amplification to boost the received optical signal.

Figure 4D:
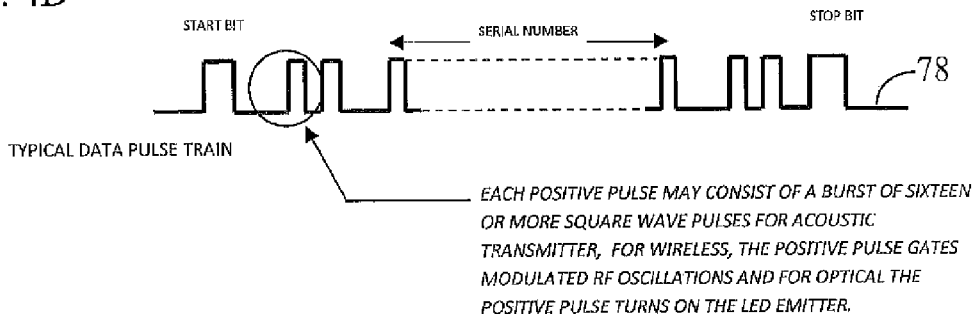
FIG. 4D depicts one possible serial data word for use with the invention.

For that matter, a 'housekeeping' type of transmission can be made on a periodic basis. FIG. 4D for example, depicts serial data 70 that includes information regarding the serial number of the particular sensor system 10, the occupancy status and the battery charge status. The sensor system 10 can be enrolled to a receiver using its serial number, or in other cases, when a short range, local transmitter is used (e.g., Bluetooth, Zigbee, Z-Wave or Wi-Fi or a proprietary communication protocol). One possible configuration of the pulse train 78 includes a start pattern, a stop pattern, data indicative of a unit serial number, status information with regards to occupancy, battery life and parity. Redundant transmissions of the same message and parity can be used to ensure error controlled reception.

The transmission is received by means for controlling the electrical supply to the target area or monitored zone based on the content of the transmitted signal, for example, the occupancy status of the focused upon area. The means for controlling is responsive to the received transmitted signal and either switches the electrical power on or off or adjusts a setting such as room temperature or lighting level. For example, the electrical power may be wired to a fluorescent, incandescent or compact fluorescent light or be used to command the output of a Light Emitting Diode (LED) luminaire's controller where brightening slope, dimming slope and unoccupied background lighting can also be programmed. In addition, the occupancy detection process can be used to control power or access to other devices such as heaters, appliances, air conditioner operation or other types of electrically powered apparatus that are designated only to be powered during periods of room occupancy, depending on the wiring.

Figure 5:
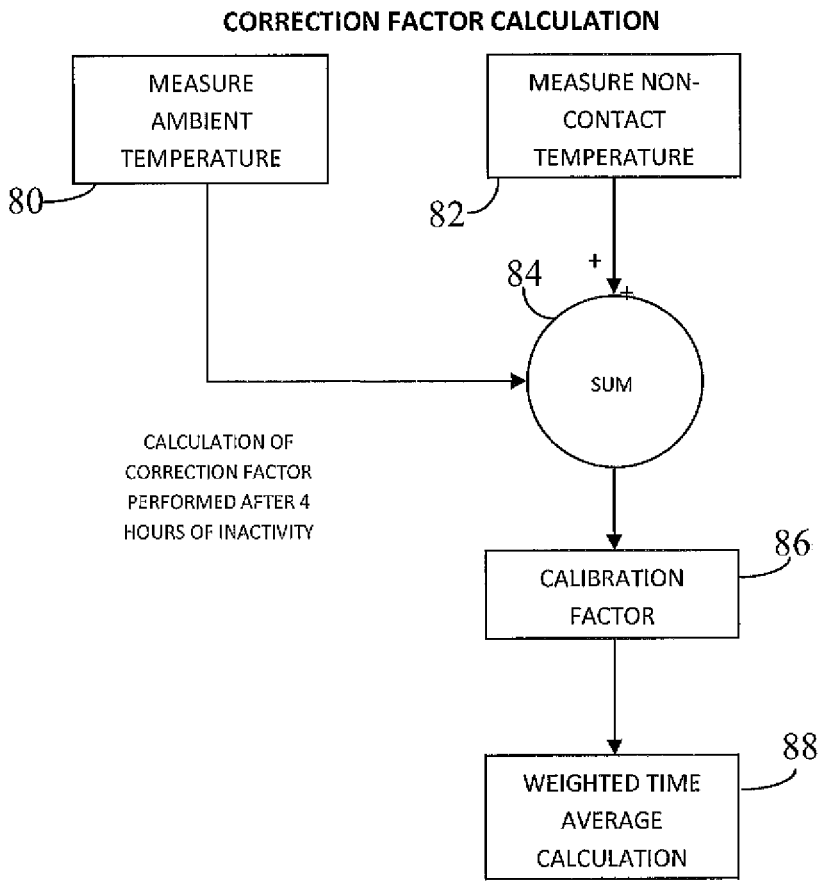
FIG. 5 depicts a schematic flow diagram highlighting a process of calculating a calibration factor for use with the invention.

FIG. 5 highlights generating a calibration factor for use in determining presence based on a difference between the temperatures of focused upon monitored area and the detected ambient air temperature.

In a step represented by block 80, the ambient air temperature is measured. A block 82 represents a step of measuring the non-contact temperature in the monitored area. Block or summation element 84 represents a step of adding the negative of the measured ambient air temperature value with the measured temperature of the monitored zone (or vice versa), to realize a difference temperature value. The time for doing this is variable, but preferably is done after several hours, e.g., 2 hours. The calibration factor 86 is then calculated by the microcomputer 18, in a step represented by block 86. The reason this factor is continuously derived is that there may be differences between the background temperature and the air temperature due to thermal effects due to other items in the field of view that may have some small amount of self-heating or areas such as a vacant seat that will cool slowly after the subject has left the seat. Based on the calibration factor, a weighted time average calculation step is carried out, as indicated by block 88.

FIG. 6 presents one way of processing the calibration factor (steps 86 and 88). That is, older measurements (A0, A1, A2, A3) are integrated into the development of the final calibration factor by use of moving window type of time weighted average, where the more recent measurements have the highest weight in the calculation. This is just an example and there can be more terms and different weighting in the final embodiment. The reader should note that absolute accuracy of the ambient temperature sensor 20, whether a separate element as shown in FIG. 1 or part of the substrate comprising the microcomputer 16, is not entirely necessary as the micro-computer can self-calibrate either or both temperature sensors.

This calibration is carried out during a time when there has not been any change detected by the thermopile detector 12, indicative of an unoccupied state. At this time, the microcomputer 16 calculates the calibration value previously mentioned that would be added to the temperature measurement taken by the thermopile detector 12. When the temperature sensor measurement value added to the calibration value is subtracted from the thermopile detector 12 temperature measurements, the results should be very close to zero in the unoccupied state. When the monitored area of the FOV is occupied by a person, calculation of the difference between the two temperature measurements will result in a value that exceeds the pre-determined threshold value. Because of this calibration, even a small change in the FOV temperature can be detected. It is also possible to add a second order correction factor by factoring in small changes in the room's ambient temperature which is being measured. Care must be taken in the design since there is a feedback control system in the room temperature thermostat that will also be part of the dynamic control of room temperature that will now contain the invention as part of the control loop.

Once the sensor system 10 detects occupancy of a person, a message is sent to the main occupancy sensor controller which can be located in the ceiling, walls or even as a physical part of the invention. The signal can be transmitted in multiple ways, as a wireless radio message, as a flash or sequence of flashes of visible or invisible light, or as an ultra-sonic tone.

The sensor can heuristically keep improving its' performance by recalibrating during times that the target area is unoccupied for a duration. For instance, if no occupancy is noted for four hours, the micro-computer can enter into a calibration cycle that uses the temperatures detected by the thermopile and ambient temperature sensors and improving the calibration factor as mentioned in the prior description. A list of older calibration factors can be mathematically combined with the latest measurement and the new calibration factor can represent a weighted average of many past values and the latest calculation. Eventually, much older calibration factor values can be deleted from the bottom of the list. In addition, during chair occupation, the value of the temperature difference for the occupant can be measured and used to constantly improve the detection threshold value to trigger notification of chair occupancy. Manipulation of this changing detection threshold value can also represent a weighted average of many past values and the latest calculation, with the latest value being dropped. As the days go by, the performance accuracy of this detector can continuously improve.

An additional adjustment is made to determine a second threshold value. That is, when a person occupies the FOV 42, for example, sits on a chair 46 therein, the chair will heat up from the person's body heat. This means that when the person gets up and leaves the FOV, there will be a smaller temperature change detected in the FOV (now seeing the chair not the person) than when the person occupied the chair/FOV. Since this is known, a different threshold can be used to detect when a person leaves an FOV/chair. In fact, the rate of change of the temperature change, caused by cooling down of the chair can be used to find the unoccupied condition as well as the instantaneous temperature value. That is, as the chair cools, the difference increases and detection that the person is no longer in the chair/FOV may be determined. This is reasonable, since it is neither necessary nor desirable to turn off the lights as soon as the person leaves the FOV, e.g., gets up and away from the chair. A delayed "unoccupied" notification is an entirely acceptable operation, wherein the threshold values are calculated using a moving time weighted average approach to improve their accuracy.

In unusual cases of very high ambient temperatures, where the background temperatures might approach the surface temperature of a human's skin or surface clothing, it is necessary to increase the capture sensitivity of this invention. This is because as the ambient temperature reaches a value close to the skin/clothing surface temperature of the person in the field of view, there is a smaller signal received due to the condition of poor thermal contrast between the occupant and the background. This is a phenomenon of the contrast of the infrared strength of the person being very close in value to that of the background. Therefore, with the smaller contrast, it is necessary to lower the threshold so that targets can be detected under this situation.

Normally, in a conventional PIR motion sensor, this problem is handled by temperature compensation, which is implemented by modification of the detection threshold voltage versus temperature; the instant invention includes the inventive temperature compensation as explained herein. There is a table of temperature compensation factors stored in the program's memory. The table consists of data for ambient air temperature versus temperature compensation factor. The corresponding ambient air temperature value is looked up and the temperature compensation factor that is associated with that temperature is fetched and combined with the normal threshold voltage. This provides for making the detection process more accurate when the ambient temperature approaches the temperature of the human occupant in the field of view.

In order to get the correct temperature compensation factor, it is advantageous if an accurate ambient temperature value is available. After the inventive PIR motion sensor system 10 is manufactured, an individually derived computer temperature correction is loaded into the microcomputer 16. At this time, the ambient temperature sensor 20 is absolutely calibrated to an accurate temperature standard in the programming fixture so that now the ambient temperature sensor measurement is corrected to measure the actual room temperature. With this calibration, temperature measurements may be taken with an accuracy of better than ±2 Centigrade degree, which leads to more precision in the development of temperature compensation factors for the PIR detection circuitry. The temperature correction factor operation is performed to cancel out the effects in ambient room temperature variations, from unit to unit of the microcomputer or thermistor.

This can also be done with the non-contact thermopile infrared sensor. It can be precisely calibrated to ideally measure a temperature exactly equal to the ambient air temperature during a manufacturing calibration operation. The result of the factory calibration can be stored in the microcomputer's non-volatile memory.

Figure 7:
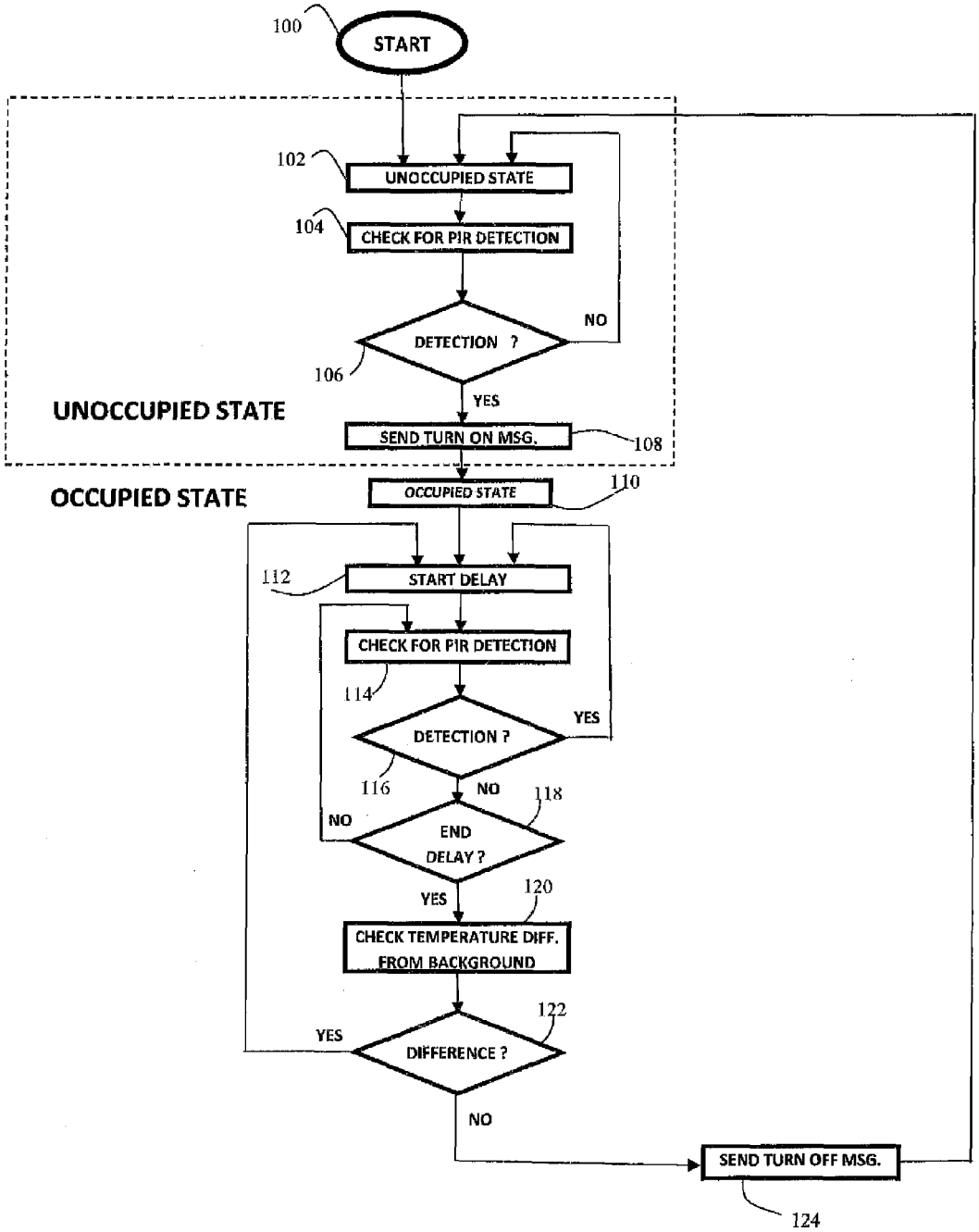
FIG. 7 is a flow chart highlighting the operation of the inventive PIR sensor of the invention.

FIG. 7 depicts a simplified process of operation of the inventive occupancy sensor system. When the unit is powered up and stabilized it enters the Start state 100 and proceeds to the occupied state. In step 102, the process checks for detection. Step 104 indicates that the microcomputer system utilizes an interrupt signal from the PIR detector 22 to determine/detect whether there is movement in the monitored area or zone. The unoccupied state (step 102), corresponds to the sleep state of the microcomputer and also is defined as the 'unoccupied' state. The microcomputer is normally in a sleep state, in order to conserve battery reserves, and the PIR detection circuitry is very low powered and operates continuously. When the PIR detects a possible person in its field of view (FOV), step 104, it generates a pulse which serves as an interrupt signal, which wakes the microcomputer from the sleep state. Decision diamond 106 indicates that the step of detecting goes on continuously, whereupon if movement is detected, the process flow moves on to step 108, where it transmits a message that the occupied state has been entered and to turn on the lights/power. Step 110 begins the 'occupied' state.

Once it has entered the occupied state step 110, a delay countdown timer is initiated 112 and a delay is started and which starts a countdown. While it is counting down it checks if any new PIR detection 114 has been made and decision diamond 116 will lead back to re-start the countdown delay 112 if a detection has been made. If no detection has been observed, a check is made if the delay has ended 118. If it has not, the delay goes on as the counter counts down, the process loops back and checks for a PIR detection 114. If the delay has ended a check is made if there is the required temperature difference 120 between the non-contact, thermopile temperature measurement and the background temperature 120. If there is a difference 122, the delay count is re-initiated to start the delay 114. If there is no temperature difference, indicating that no one is sitting in the FOV, and the room is vacant a 'turn off' message is transmitted 124 which shuts off lighting and power and the system returns to the unoccupied state 102.

LISTING OF ELEMENTS

10 PIR motion sensor and non-contact temperature measurement system
12 Thermopile Detector
14 Thermopile Conditioning Circuit
16 Microcomputer
18 Oscillator
20 Ambient Temperature Sensor
22 Pyroelectric Detector
24 Amplifier, Filtering & Conditioning Circuitry
26 Battery
28 Transmitter
30 Battery Clip
32 Antenna
34 Filter & Matching Network
38 Misc. Components
40 ceiling
42 Field of View of Thermopile Detector/system
44 Person
46 Chair
48 desk or table
49*a* keyboard
49*b* computer including display
50 PCB

54 Power Controller
56 Oscillator, RF
57 Pulse Modulator
58 Power Amplifier
60 Plastic Case
62 Lens
70 Driver
72 Ultrasonic Transducer
74 Current Driver
76 Light Emitting Diode
78 Waveform
80 Measure Ambient Temperature
82 Measure Non-Contact Temperature
84 Sum
86 Calibration Factor
88 Weighted Time Average Calculation
100 step
102 step
104 step
106 step
108 step
110 step
112 step
114 step
115 step
118 step
120 step
122 step As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A passive infrared (PIR) motion sensor system, comprising:

a microcomputer;

a pyroelectric detector formed with a Fresnel lens and arranged to receive multiple passive PIR beams from a portion of the room or zone, wherein upon sensing a moving human, the pyroelectric sensor generates a pyroelectric interrupt signal and provides the pyroelectric interrupt signal to the microcomputer;

an ambient temperature sensor for measuring an ambient temperature in the room or zone, wherein the ambient temperature sensor generated an ambient temperature signal and provides the ambient temperature signal to the microcomputer;

a non-contact thermopile detector for performing a non-contact temperature measurement by capturing infrared energy from a selected focused upon area in the room or zone, generating a thermopile temperature signal therefrom, and providing the thermopile temperature signal to the microcomputer;

a controller for enabling an electrical current supply to the room or zone upon receipt of an occupied signal that defines an occupied state in the room or zone, and disabling the electrical current supply to the room or zone upon receipt of an unoccupied signal that defines an unoccupied state in the room or zone;

wherein upon receipt of a pyroelectric interrupt signal, the microcomputer initiates a determination of whether the pyroelectric interrupt signal is a valid signal;

wherein if the microcomputer determines that the pyroelectric interrupt signal is not a valid signal, the microcomputer provides the unoccupied signal to the controller, sustaining the unoccupied state; and wherein if the microcomputer determines that the pyroelectric interrupt signal is a valid signal, 1) the microcomputer generates and outputs the occupied signal to the controller, either changing from an unoccupied state to an occupied state or sustaining the occupied state; and 2) if after a programmed length of time in which the microcomputer does not receive a piezoelectric interrupt signal that is a valid signal, the microcomputer processes the thermopile temperature signal and the ambient temperature signal to determine if there is a difference between the ambient temperature signal and the thermopile temperature signal;

a) wherein if there is a difference between the ambient temperature signal and the thermopile temperature signal, the microcomputer concludes that the room or zone is occupied and outputs the occupied signal to the controller to sustain the occupied state; and b) wherein upon determining substantially no difference between the ambient temperature signal and the thermopile temperature signal, the microcomputer concludes that the room or zone is unoccupied and generates and outputs the unoccupied signal to the controller to change to the unoccupied state.

2. The passive infrared (PIR) motion sensor system of claim 1, further comprising a transmitter, wherein the microcomputer sends the occupied or unoccupied signal to the transmitter and wherein the transmitter generates a transition signal at periodic or aperiodic intervals, representing an occupied or unoccupied state of the room or zone.

3. The passive infrared (PIR) motion sensor system of claim 2, wherein the transmitter transmits the transition signal to the controller.

4. The passive infrared (PIR) motion sensor system of claim 1, wherein the thermopile detector is directed at the area focused upon to measure a temperature of a surface of skin or clothes of a human in the monitored room or zone, if present and an inanimate object at the focused upon area if there is no human present.

5. The passive infrared (PIR) motion sensor system of claim 1, further comprising a battery or a solar cell or a light or thermal energy to DC power converting or an adaptor for connection to a conventional alternating current (AC) supply of electrical current.

6. The passive infrared (PIR) motion sensor system of claim 1, further comprising a housing including a single or dual lens window portion through which the non-contact thermopile detector and the pyroelectric detector capture infrared light energy.

7. The thermopile detection system of claim 1, wherein the microcomputer generates a difference factor for use in determining occupancy based on the difference between the temperatures of the focused upon area and the detected ambient air temperature.

8. The invention of claim 1, wherein microcomputer incorporates a temperature calibration factor for detecting the actual room temperature and using said actual room temperature for adjusting a sensitivity of the motion detector and for correction of thermopile detector measured values.

9. The passive infrared (PIR) motion sensor system of claim 8, wherein the temperature calibration factor and hence a derivative calculated threshold value is based on an average of ambient temperature signals captured by the non-contact thermopile detector or a thermistor temperature sensor over a fixed time period.

10. The passive infrared (PIR) motion sensor system of claim 9, wherein the temperature corrected by the calibration factor is processed to contribute to the generation of the PIR detection threshold voltage and is generated during a time when there has not been any movement detected by the pyroelectric detector, which is indicative of an unoccupied state.

11. A method of using a passive infrared (PIR) motion sensor system to control an electrical current supply to a room or zone based on a determination that the room or zone is occupied or unoccupied, the system comprising a non-contact thermopile detector, a pyroelectric detector formed with a Fresnel lens and arranged to focus upon a portion of the room or zone, an ambient temperature sensor and a microcomputer, the method comprising the steps of:

generating a thermopile temperature signal by the non-contact thermopile detector and providing the thermopile temperature signal to the microcomputer;

generating an ambient temperature signal by the ambient temperature sensor and providing the ambient temperature signal to the microcomputer;

if a person is detected to move in the zone or room by the pyroelectric detector, generating an interrupt signal and a valid data by the pyroelectric detector and providing the interrupt signal and the valid data signal to the microcomputer, awakening in response to the interrupt signal by the microcomputer and if there is a valid data signal, generating an occupied signal by the microcomputer and providing the occupied signal to a controller to set an occupied state of the room or zone to thereby enable or maintain the electrical current supply to the room or zone;

if a person is not detected to move in the zone or room by the pyroelectric detector, after the microcomputer has received the valid data signal, the microcomputer periodically comparing the non-contact temperature signal and the ambient temperature signal to determine whether there is a temperature difference therebetween;

upon detecting a temperature difference, maintaining the occupied signal to the controller to enable or maintain the electrical current supply to the room or zone; and upon detecting substantially no temperature difference, generating and providing an unoccupied signal to the controller to set the unoccupied state to thereby reduce or extinguish the electrical current supply to the room or zone.

* * * * *